US008469195B2

(12) United States Patent
Gosselink et al.

(10) Patent No.: US 8,469,195 B2
(45) Date of Patent: Jun. 25, 2013

(54) STORAGE CONTAINER AND TRAY

(75) Inventors: Mary Elizabeth Ward Gosselink, Washington, DC (US); Paul Hornikx, Shenzhen (CN)

(73) Assignee: Mary Elizabeth Ward Gosselink, Washington, DC (US)

( * ) Notice: Subject to any disclaimer, the term of this patent is extended or adjusted under 35 U.S.C. 154(b) by 0 days.

(21) Appl. No.: 13/357,154

(22) Filed: Jan. 24, 2012

(65) Prior Publication Data

US 2012/0187020 A1 Jul. 26, 2012

Related U.S. Application Data

(60) Provisional application No. 61/436,044, filed on Jan. 25, 2011.

(51) Int. Cl.
*B65D 71/00* (2006.01)

(52) U.S. Cl.
USPC ..... 206/769; 206/575; 206/815

(58) Field of Classification Search
USPC ..... 206/574, 575, 581, 769, 775, 776, 206/781, 782, 815
See application file for complete search history.

(56) References Cited

U.S. PATENT DOCUMENTS

| | | | | |
|---|---|---|---|---|
| 3,493,102 | A | 2/1970 | Belokin, Jr. | |
| 5,011,018 | A * | 4/1991 | Keffeler | 206/532 |
| 5,806,670 | A | 9/1998 | Harlan et al. | |
| 6,015,064 | A * | 1/2000 | Liu | 220/524 |
| 6,213,304 | B1 * | 4/2001 | Juliussen | 206/581 |
| 6,386,209 | B1 * | 5/2002 | Yuhara et al. | 132/294 |
| 6,471,060 | B1 * | 10/2002 | Leyshon | 206/473 |
| 6,612,454 | B1 * | 9/2003 | Lin | 220/23.88 |
| D525,777 | S | 8/2006 | Priebe et al. | |
| 7,357,250 | B2 * | 4/2008 | Hagemann et al. | 206/315.11 |
| 2005/0178693 | A1 | 8/2005 | Gupta | |
| 2005/0269231 | A1 | 12/2005 | White et al. | |
| 2006/0070900 | A1 * | 4/2006 | Brunson et al. | 206/373 |

* cited by examiner

*Primary Examiner* — Jacob K Ackun
(74) *Attorney, Agent, or Firm* — Sofer & Haroun, LLP

(57) ABSTRACT

A tray and storage containers combination includes a tray having a bottom, side walls and an open top configured to receive a lid. A plurality of containers are configured to be arranged within the tray, each of which having a top wall and a bottom wall, two side walls and a back wall, each of the plurality of the containers having an openable lid. The containers are positioned in the tray to rest on their respective bottom walls so that the lids of the plurality of the containers face a side wall of the tray.

12 Claims, 5 Drawing Sheets

STORAGE CONTAINER AND TRAY

RELATED APPLICATION

This application claims the benefit of U.S. Provisional Patent Application No. 61/436,044, filed on Jan. 25, 2011, the entirety of which is incorporated by reference.

BACKGROUND

1. Field of the Invention

This application relates to a storage container. More particularly, this application relates to a storage container for organization of small craft items.

2. Description of Related Art

People who work with beads either as a hobby or in their profession may accumulate hundreds of different designs and types of beads which vary by color and size as well as material. It is difficult to easily store the multitude of types of beads such that they are all visually accessible and easily retrievable to the person during use, as well as providing containers that are easily transportable.

U.S. Patent Publication No. 2005/0178693 to Gupta discloses a beadwork kit, a lap desk for bead working, a bead stringing tray and a weaving tray, the trays being interchangeable in the kit and desk and also being capable of being used alone. The kit has a case having a cover and a base. The cover includes a plurality of compartments within which beads containers are received. A further compartment is provided for holding scissors or other tools. The base also includes a storage compartment which underlies a beadwork tray. The beading tray is for engaging beads in a straight line such as for making bracelets, necklaces, with a plurality of grooves therein which may include indicia associated therewith for determining the final length of the project.

U.S. Pat. No. 3,493,102 to Belokin discloses a tackle and utility box formed of a pair of substantially identically shaped molded members having converging top and bottom walls and integral side and end walls with matching inner open sides, hinged to each other along one edge so that in a closed position the molded members adjoin at their open sides to form an enclosure and in open position the sides of the members fold out into a flat base with the open inner skies directed upwardly at an angle to each other. At least one compartmented tray is included, hinged at its bottom across the open inner side of one of the molded members. In the closed position, the sides of the hinged compartmented trays serve as covers for the fixed compartments in both molded members and in open position the trays can be rotated to provide access to the compartments.

U.S. Pat. No. 5,806,670 to Harlan discloses a multi-compartment pillbox with compartment size as chosen by the user, snap shut lids to close all compartments, and a boatlike structure to aid in filling each compartment. The unit may be manufactured using clear or colored plastic. The rounded bottoms in the compartments are a necessity for easy removal of pills.

U.S. Patent Publication No. 2005/0269231 to White discloses a container useful for both packaging a device and for transferring the device from the container to its place of use with a minimum amount of contamination of the user by the device. The container has a first container portion and a second container portion. One of the container portions is provided with a grip that is graspable by a user's hand and a holder for holding the device using the same portion of the container to permit that portion of the container to be gripped and used to transfer the device from the container to another location without having to directly contact the device. Corner indentations are designed to provide a convenient location to grasp the first container portion between two finger of one hand when opening or closing the container.

OBJECTS AND SUMMARY

Although the above described containers are suitable for various purposes, they do not offer specific features that are directed to the storage, transport and easy removal of small craft products such as beads.

One object of the present invention is to provide a storage container which allows a person to easily organize, transport and visually distinguish many different types and colors of beads at one time. The present invention allows benders to organize components by color, giving them the flexibility to find the right sized container for every bead in their collection.

Another object of the prevent invention is to provide a convenient way to store bead projects safely until completion which is also transportable.

The present invention addresses the aforementioned concerns by providing storage containers of various sizes and an outer tray for the storage of a plurality of beads and for the separation of many kinds of beads. Multiple storage containers of various sizes are positioned in the outer tray. The tray and storage containers are made from a clear plastic material to provide visual access to a multitude of beads stored therein. The storage containers have large rounded corners to easily remove small objects.

The containers lay on their sides so the contents are visible through the transparent container walls and the clear tray lid. The containers are oriented so that the lid of each container is not facing upwards, rather the containers rest in the tray with their lids positioned facing the user. This orientation allows the user to see through the transparent walls of the container and view the contents as opposed to looking through the lids of each container.

In another aspect of the invention, in order to easily extract a single container from the tray, each container has thumb scoops and grip wing features on its front and back sides. The grip wings are part of the container and the lifting force is not in the opening direction of the lid, thus keeping the lid securely dosed while lifting the container from the tray. If the lids were positioned upwards, these grip wings on the lid might cause the lid to open inadvertently and release all the contents.

BRIEF DESCRIPTION OF DRAWINGS

The present invention can be best understood through the following description and accompanying drawings, wherein.

DETAILED DESCRIPTION

Figure 1:
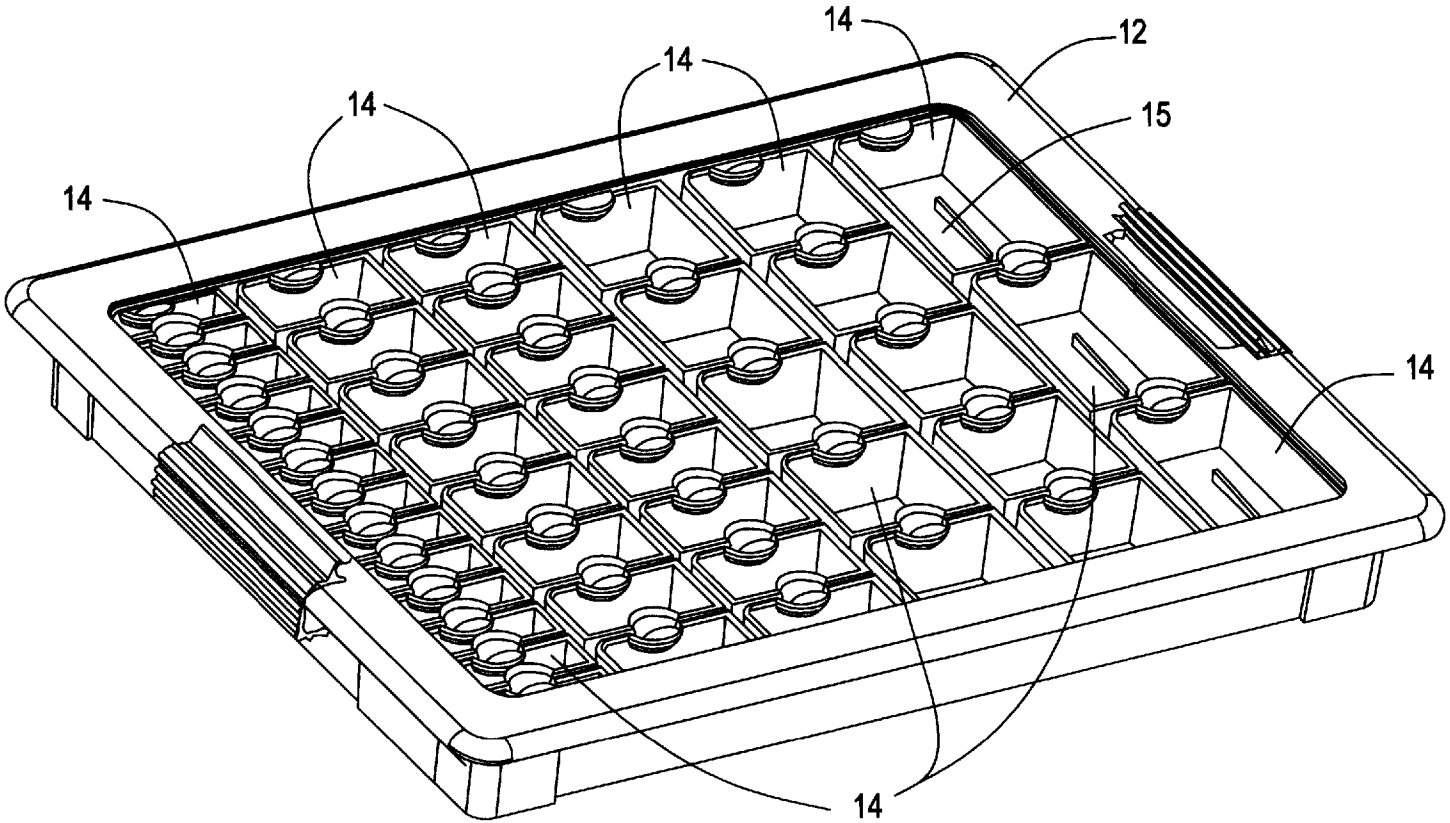
FIG. 1 is a planar view of a tray with storage containers, according to one embodiment.

Referring to FIG. 1, a tray 12 is formed from a polymer and configured to store a plurality of storage containers 14, each of which is configured to independently store a particular small product. In this arrangement, a single tray 12 may be used to organize, store, transport and use a wide variety of small products, including craft products such as beads and the like.

For the purpose of illustrating the salient features of the present invention, tray 12 and storage containers 14 are described in conjunction with the storage of craft products, such as small colored beads. However, it is understood that the presently described tray 12 and storage containers 14 can be used with a wide variety of small craft items.

Tray 12 is ideally made from a sturdy polymer material and may either be opaque, translucent or clear. However, storage containers 14 are ideally made from a transparent polymer so that a user may easily identify the material inside.

According to the present arrangement, tray 12 may be sized to include any configuration of the various sized storage containers 14. Tray 12 may be in any size and depth that is suitable for bead storage e.g. a depth of several inches and a dimension of 6"×6" up to 24"×24."

For example, in one preferred embodiment, as shown in FIG. 1, thirteen extra small sized containers 14 fill one row of tray 12. This size may be useful for seed beads and tiny findings such as crimp beads and the like. Eight small sized containers 14 fill another row of tray 12. This size may be useful for primary bead storage. Five medium size containers 14 fill another row in tray 12. Three large sized containers 14 fill another row of tray 12. These larger sizes may be useful for large beads and head pins.

In a preferred embodiment of the present invention, a lid 15 of tray 12 and the walls of containers 14 are made of a clear transparent material such as clear polymer. Lids 16 of containers 14, however may be either transparent or opaque. As such, the content of containers 14 can be viewed through the transparent lid 15 of tray 12 and the transparent walls of containers 14.

Figure 2:
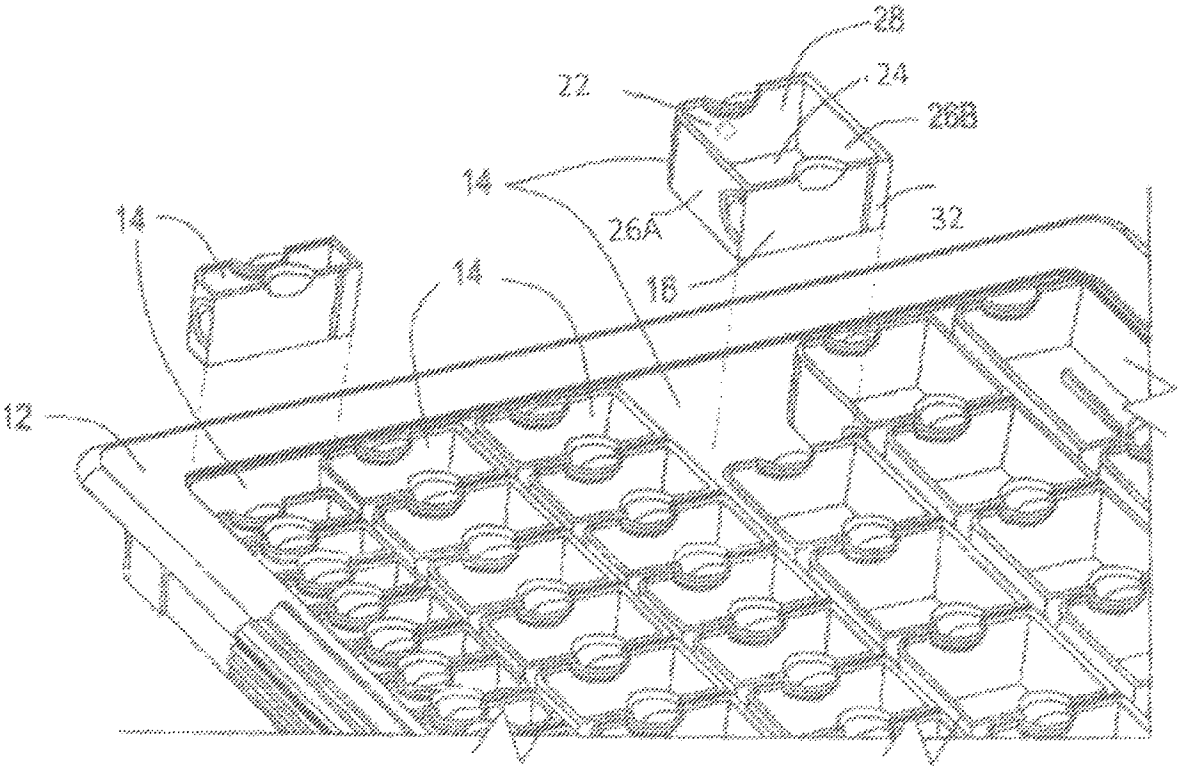
FIG. 2 is a dose up view of the tray and storage containers of FIG. 1, according to one embodiment.

Referring to FIG. 2, each of containers 14 preferably have a top wall 22, bottom wall 24, two side walls 26*a*, 26*b*, a lid 16 and a back wall 28. Containers 14 are positioned in tray 12 to rest on their bottom walls 24. Opaque lids 16 face forwards toward a front side of tray 12 as opposed to upwards towards lid 15. As such, the contents of containers 14 can be viewed through their transparent clear plastic top wall 22 even when containers 14 are in tray 12. Additionally, the contents of containers 14 may be viewed through each of side walls 26*a* and 26*b*, bottom wall 24 and back wall 28 when they are out of tray 12. Opaque lids 16 help to set sharp definitions between containers 14 when they are dose together in tray 12 to help users easily identify one container full of beads from another.

As shown in FIG. 2, as tray 12 is filled with rows of containers 14, containers 14 are positioned so that lid 16 of one container 14 abuts back wall 28 of the adjacent container 14 in the same row. This orientation ensures that containers 14 are secured shut once tray 12 is filled with a full number of containers per row. Therefore, if tray 12 is accidentally dropped, due to the forward configuration of lids 16, lids 16 of containers 14 remain closed and the contents are not spilled or intermingled.

Figure 3:
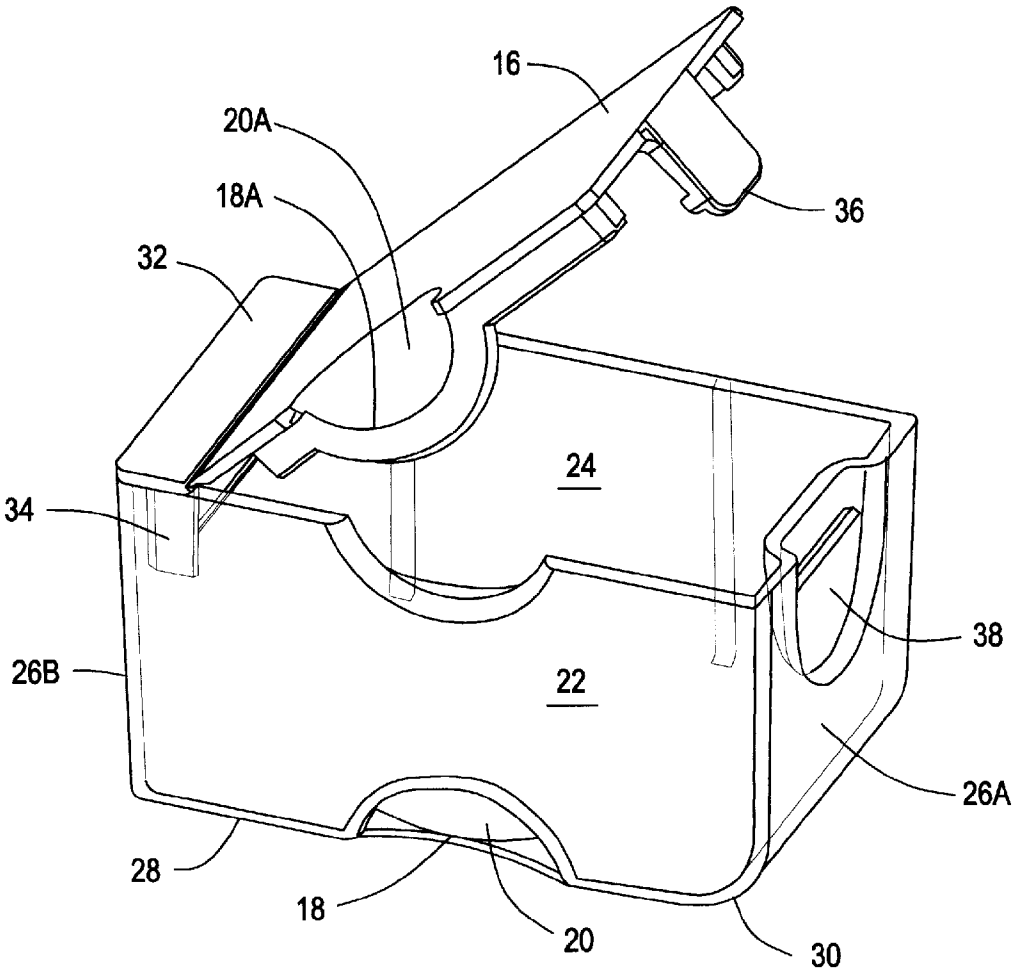
FIG. 3 is a perspective view of an individual storage container of FIG. 1 in an open state, according to one embodiment of the present invention.
Figure 4:
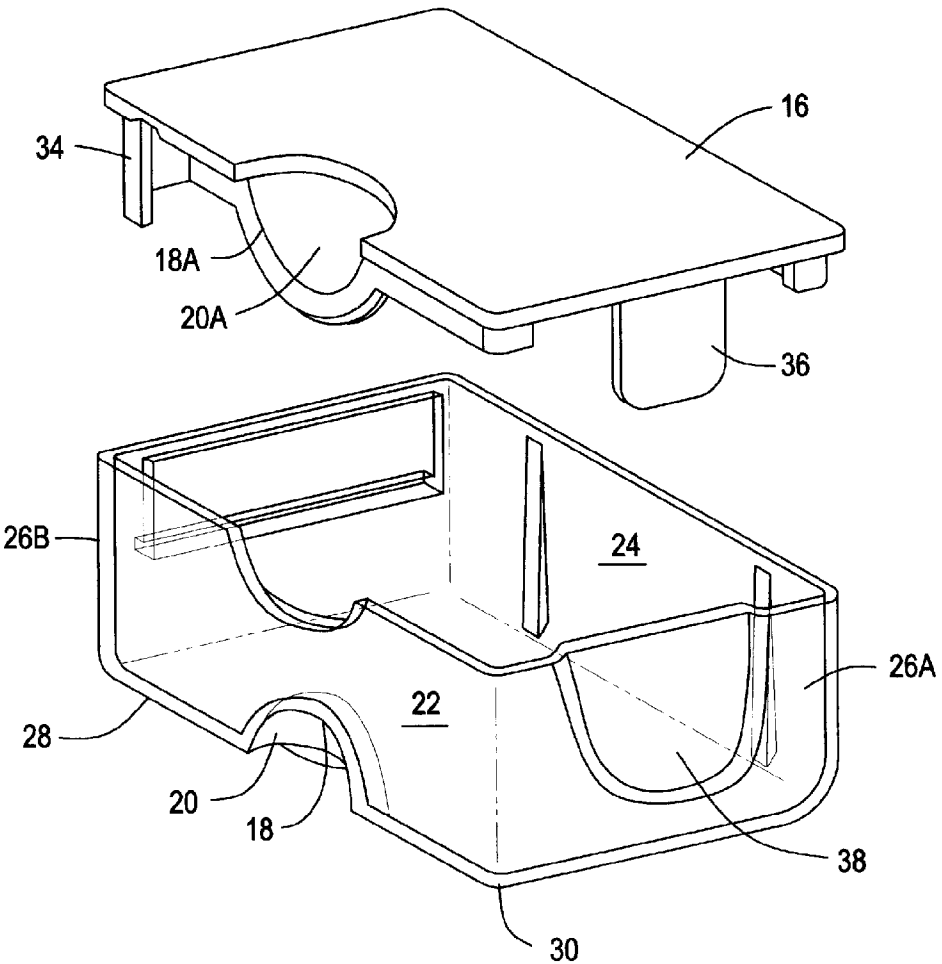
FIG. 4 is a perspective view of an individual storage container of FIG. 1, illustrating grip wings, according to one embodiment of the present invention.
Figure 5:
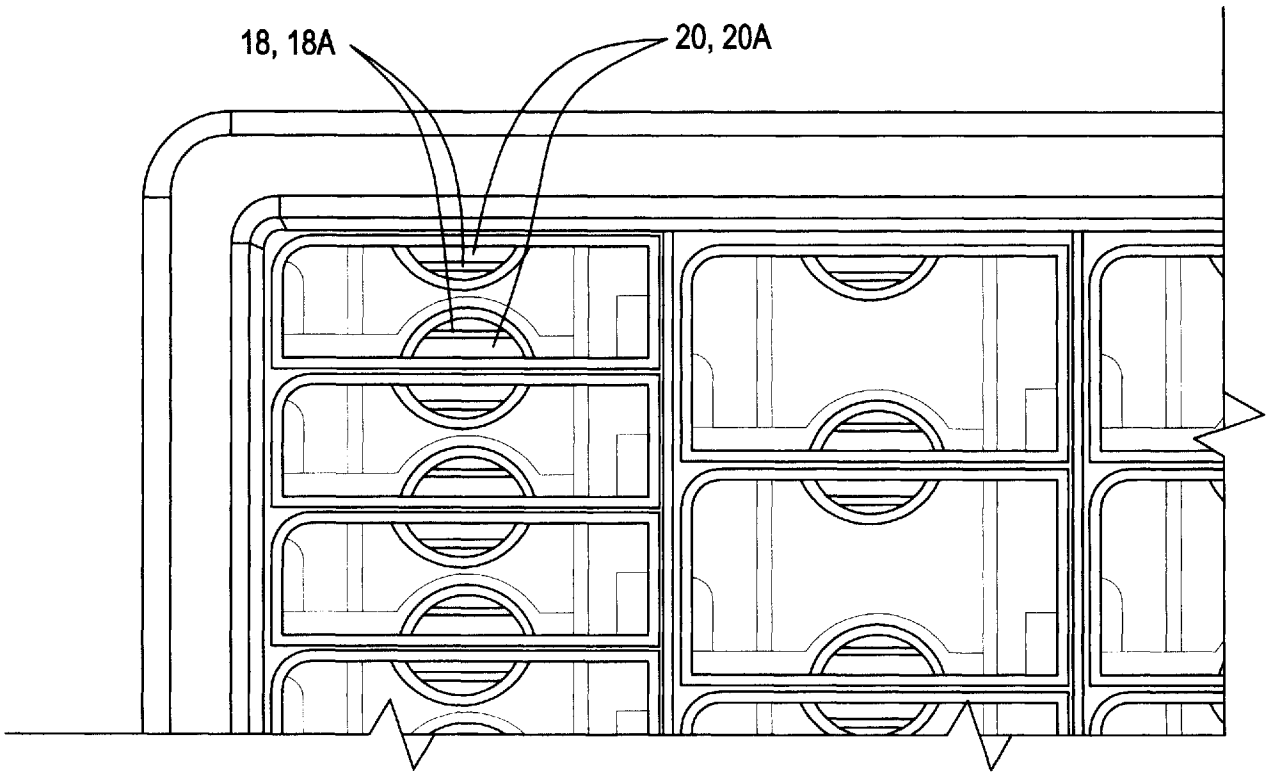
FIG. 5 is a planar view of several storage containers, illustrating grip wings and thumb scoops, according to one embodiment of the present invention.

Referring now to FIGS. 3-5, FIG. 5 shows a close up view of several containers 14 in tray 12. Each of containers 14 has a grip wing 18 and thumb scoop 20 as part of container 14 formed directly into a back side (facing back side 28) of top wall 22. In this context, scoop 20 allows room for the finger to fit in between containers 14 and grip wing 18 provides a ledge for the finger to press against. Also shown in FIGS. 3-5, each of lids 16 has a corresponding grip wing 18A and thumb scoop 20A as part of lid 16, which fits into an appropriate corresponding opening of container 14. In this arrangement container 14 and lid 16 together have two grip wings 18, 18A and thumb scoops 20, 20A in order to facilitate a user extracting a single container 14 from tray 12 using their fingers.

Referring to FIGS. 3 and 4, once container 14 is extracted from tray 12 and the user desires to access its contents, lid 16 can either be opened (FIG. 3) or be entirely removed (FIG. 4) from container 14 in order to have access the contents of container 14.

As shown in FIG. 3, showing the partially opened lid 16, lid 16 is attached to container 14 via a hinge 32. On the hinged end of lid 16, a projection 34 on each corner of lid 16 fits within a corresponding recess on a side wall (26*b*) of container 14. On the opening end of the lid, a tongue 36 fits within a corresponding recess 38 on a side wall (26*a*) of container 14 in order to secure lid 16 to container 14 in a dosed position. Due to the hinged connection, lid 16 can be flipped open without completely removing lid 16 in order to have quick access to the contents of containers 14. In this arrangement, the opening end of lid 16 by tongue 36 faces a side wall (26*a*) and, as such, when removing a container 14 from tray 12, the lifting force is not in the opening direction of lid 16 so that lid 16 remains closed while container 14 is removed and the contents remain within container 14 without spilling. This arrangement is further protected from accidental opening when removing a container 14 from tray 12 because one finger of a user is pressing on grip wing 18 and thumb scoop 20 built directly into container 14 whereas the opposing finger is pressing on grip wing 18A and thumb scoop 20A of lid 16, thus holding lid 16 tightly during the removal process.

As shown in FIGS. 3 and 4, containers 14 are additionally configured to have rounded corners 30, such as along side wall 26*a* so as to allow for easier removal of small objects within containers 14 and likewise to prevent sticking of containers 14 to one another when they are removed from and inserted into tray 12.

As noted above, although such a tray 12 and containers 14 are directed in a preferred embodiment for use in storage of beads, it is understood that such tray 12 and containers 14 may likewise be used to hold temporarily strung beads, pendants, oversized beads, bottles of resin, jars of modge podge, rods of glass, glue guns, soldering iron, blocks of polymer clay and all oversized materials.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

We claim:

1. A tray and storage containers combination comprising;

a tray having a bottom, side walls and an open top configured to receive a lid;

a plurality of containers configured to be arranged within said tray, each of said containers having atop wall and a bottom wall, two side walls and a back wall, each of said plurality of said containers having an openable lid opposite said back wall;

wherein said containers are positioned in said tray to rest on their respective bottom walls so that said lids of said plurality of said containers face a side wall of said tray, wherein said plurality of said containers further include first thumb scoops traversing both said back side of said top walls and said back walls of said container, and wherein said lids of said containers and said top walls, opposite said first thumb scoops on said top walls and back walls, include second thumb scoops traversing both said front side of said top walls and said lids of said container, so that when said first and second thumb scoops are configured to be pinched between fingers of a user removing one of said containers from said tray, and thereby pressing at least partially on said lid of said at least one container so that said lid does not open during said removal.

2. The tray and storage containers combination according to claim 1 wherein said tray is filled with said containers in rows.

3. The tray and storage containers combination according to claim 2 wherein said containers are positioned within said tray so that said lids of one of said plurality of container abuts a said back wall of an adjacent container among said plurality of said containers in the same said row.

4. The tray and storage containers combination according to claim 1 wherein said containers further comprise rounded corners.

5. The tray and storage containers combination according to claim 1 wherein said containers further comprise wing grips within said first and second thumb scoops in order to extract said containers from said tray.

6. The tray and storage containers combination according to claim 1 wherein said lids of said plurality of said containers open towards one of said side walls of said containers.

7. The tray and storage containers combination according to claim 1 further comprising a lid for said tray, said tray lid made of transparent plastic.

8. The tray and storage containers combination according to claim it wherein said walls of said containers are made of transparent plastic.

9. The tray and storage containers combination according to claim 1 wherein said lid of said container is opaque.

10. The tray and storage containers combination according to claim 1 wherein said plurality of containers further comprises containers of varying sizes.

11. The tray and storage containers combination according to claim 1 wherein said lids of said plurality of containers are connected to said containers via a hinge.

12. The tray and storage containers combination according to claim 1 wherein said lids of said plurality of containers are entirely removable from said containers.

* * * * *

UNITED STATES PATENT AND TRADEMARK OFFICE

CERTIFICATE OF CORRECTION

PATENT NO. : 8,469,195 B2
APPLICATION NO. : 13/357154
DATED : June 25, 2013
INVENTOR(S) : Gosselink et al.

It is certified that error appears in the above-identified patent and that said Letters Patent is hereby corrected as shown below:

In the Claims:

Claim 1, Column 4, Line 56: The word "atop" between the words "having" and "wall" should be "a top".

Claim 8, Column 6, Line 8: The word "it" between the words "claim" and "wherein" should be "1".

Signed and Sealed this
Third Day of September, 2013

Teresa Stanek Rea
*Acting Director of the United States Patent and Trademark Office*